US011878723B2

(12) United States Patent
Entchev et al.

(10) Patent No.: US 11,878,723 B2
(45) Date of Patent: Jan. 23, 2024

(54) SYSTEM FOR TRANSPORTING SAND FOR WELLBORE OPERATIONS

(71) Applicant: ExxonMobil Technology and Engineering Company, Spring, TX (US)

(72) Inventors: Pavlin B. Entchev, Spring, TX (US); Charles A. Hope, Spring, TX (US); Jose Alberto Ortega Andrade, Spring, TX (US); Michael W. Clark, The Woodlands, TX (US)

(73) Assignee: ExxonMobil Technology and Engineering Company, Spring, TX (US)

( * ) Notice: Subject to any disclaimer, the term of this patent is extended or adjusted under 35 U.S.C. 154(b) by 925 days.

(21) Appl. No.: 15/930,766

(22) Filed: May 13, 2020

(65) Prior Publication Data

US 2020/0406936 A1 Dec. 31, 2020

Related U.S. Application Data

(60) Provisional application No. 62/866,862, filed on Jun. 26, 2019.

(51) Int. Cl.
*B61B 7/06* (2006.01)
*B61B 12/12* (2006.01)
(Continued)

(52) U.S. Cl.
CPC ..... *B61B 7/06* (2013.01); *B61B 12/028* (2013.01); *B61B 12/10* (2013.01); *B61B 12/122* (2013.01); *E21B 43/267* (2013.01); *E21B 43/27* (2020.05)

(58) Field of Classification Search
CPC .... B61B 7/00; B61B 7/02; B61B 7/06; B61B 10/02; B61B 10/022; B61B 12/028;
(Continued)

(56) References Cited

U.S. PATENT DOCUMENTS 4,401,034 A * 8/1983 Gaudet ..... B61B 12/10 104/178
5,172,640 A * 12/1992 Cathiard ..... B61B 12/022 104/178

(Continued)

FOREIGN PATENT DOCUMENTS

AU 2015274317 A1 * 12/2016 ..... B61B 1/005
KR 200336877 Y1 * 12/2003 ..... B61B 7/00

*Primary Examiner* — S. Joseph Morano
*Assistant Examiner* — Cheng Lin
(74) *Attorney, Agent, or Firm* — ExxonMobil Technology and Engineering Company—Law Department

(57) ABSTRACT

A transport system for carrying a proppant, the system comprising a loading tower, a first transfer tower, a second transfer tower and an unloading tower. The loading tower is located proximate a loading area while the unloading tower is located proximate an unloading area. The system also includes a first transfer tower and a second transfer tower. A first aerial cable conveys a transfer container from the loading tower to the first transfer tower, while a second aerial cable conveys the transfer container from the second transfer tower to the unloading tower. The transfer container is configured to be suspended from the first and second aerial cables en route from the loading tower to the unloading area. Sand or supplies from the transfer container is received at the unloading area for use in a wellbore operation. Methods of transporting sand for use in wellbore fracturing operations are also provided.

6 Claims, 7 Drawing Sheets

(51) Int. Cl.

| | |
|---|---|
| ***B61B 12/10*** | (2006.01) |
| ***B61B 12/02*** | (2006.01) |
| *E21B 43/27* | (2006.01) |
| *E21B 43/267* | (2006.01) |

(58) Field of Classification Search
CPC ..... B61B 12/10; B61B 12/12; B61B 12/122; E21B 43/267; E21B 43/27; E21B 7/00
See application file for complete search history.

(56) References Cited

U.S. PATENT DOCUMENTS

| | | | | |
|---|---|---|---|---|
| 8,622,251 | B2 * | 1/2014 | Oren | B65G 65/23 222/561 |
| 8,910,578 | B2 * | 12/2014 | Gubler | B61L 23/002 104/173.1 |
| 9,010,251 | B2 * | 4/2015 | Creissels | B61B 1/02 104/30 |
| 9,790,022 | B2 * | 10/2017 | Sheesley | B65D 90/587 |
| 10,501,685 | B2 * | 12/2019 | Pal | E21B 33/14 |

* cited by examiner

SYSTEM FOR TRANSPORTING SAND FOR WELLBORE OPERATIONS

CROSS-REFERENCE TO RELATED APPLICATION

This application claims the benefit of U.S. Provisional Application 62/866,862 filed Jun. 26, 2019 entitled SYSTEM FOR TRANSPORTING SAND FOR WELLBORE OPERATIONS, the entirety of which is incorporated by reference herein.

BACKGROUND OF THE INVENTION

This section is intended to introduce various aspects of the art, which may be associated with exemplary embodiments of the present disclosure. This discussion is believed to assist in providing a framework to facilitate a better understanding of particular aspects of the present disclosure. Accordingly, it should be understood that this section should be read in this light, and not necessarily as admissions of prior art.

Field of the Invention

The present disclosure relates to the field of hydrocarbon recovery operations. More specifically, the present invention relates to the development of unconventional hydrocarbon resources using proppant. Further still, the invention relates to the transportation of proppant from a central gathering facility to well sites in an area of wellbore operations.

Technology in the Field of the Invention

In the completing of oil and gas wells, a wellbore is formed using a drill bit that is urged downwardly at a lower end of a drill string. The drill bit is rotated while force is applied through the drill string and against the rock face of the formation being drilled. After drilling to a predetermined depth, the drill string and bit are removed and the wellbore is lined with a string of casing. The process of drilling and then installing casing is repeated until the wellbore has reached "total depth."

Advances in drilling technology have enabled oil and gas operators to "kick-off" and steer wellbore trajectories from a generally vertical orientation to a generally horizontal orientation. The horizontal "leg" of each of these wellbores now often exceeds a length of one mile, and sometimes two or even three miles. This significantly multiplies the wellbore exposure to a target hydrocarbon-bearing formation (or "pay zone"). As an example, consider a target pay zone having a (vertical) thickness of 100 feet. A one-mile horizontal leg exposes 52.8 times as much pay zone to a horizontal wellbore as compared to the 100-foot exposure of a conventional vertical wellbore.

Within the United States, many wells are now drilled to recover oil and/or natural gas, and potentially natural gas liquids, from pay zones previously thought to be too impermeable to produce hydrocarbons in economically viable quantities. Such "tight" or "unconventional" formations may be sandstone, siltstone, or even shale formations. Alternatively, such unconventional formations may include coalbed methane. In any instance, such formations have "low permeability," such as less than 0.1 millidarcies.

In order to enhance the recovery of hydrocarbons, particularly in low-permeability formations, stimulation techniques may be employed in the pay zone. Such techniques include hydraulic fracturing and/or acidizing. In addition, "kick-off" wellbores may be formed from a primary wellbore in order to create one or more new directionally or horizontally completed boreholes. This allows a well to penetrate along the depositional plane of a subsurface formation to increase exposure to the pay zone. This exposure is further increased by forming multiple fractures along the length of a horizontal wellbore, forming so-called frac-wings. The frac-wings typically propagate vertically, creating in essence multiple vertical completions.

The ability to replicate multiple vertical completions along a single horizontal wellbore is what has made the pursuit of hydrocarbon reserves from unconventional reservoirs, and particularly shales, economically viable within relatively recent times. This technology has had such an impact that currently Baker Hughes Rig Count information for the United States indicates only about one out of every fifteen (7%) of wells being drilled in the U.S. are classified as "Vertical", whereas the remainder are classified as either "Horizontal" or "Directional" (85% and 8%, respectively). Further, total frac stages have been increasing by over 10% per year.

A by-product of the industry's success in completing horizontal wellbores in tight formations is a growing need for sand. Those of ordinary skill in the art will understand that sand is mixed into the aqueous fluid used for formation fracturing. The sand serves as a proppant, holding the tight formation open after pumping pressure is released and enabling formation fluids to flow more freely towards the wellbore.

The industry obtains sand from sand mines, most commonly located in Wisconsin, Illinois, Minnesota or Texas. The sand is transported from the mines to processing plants, either by rail or by a conveyor system. In some cases, the sand is filtered on-site and is delivered directly to well sites using trucks. In an area where fracturing operations are taking place, the county and farm-to-market roads can become clogged with literally hundreds of trucks carrying everything from water to blenders to piping to sand to the work crews themselves. This places a tremendous burden on small roads, the largest burden coming from the sand trucks themselves.

Accordingly, a need exists for an improved over-land system for transporting sand from a central gathering facility to various well sites. A need further exists for such a system that employs a cable lift that minimizes or even eliminates the need for trucking of sand from the point of loading to points of unloading.

BRIEF SUMMARY OF THE DISCLOSURE

A transport system is first provided herein. The transport system is designed to carry people and supplies from a loading area to an unloading area. This is done in support of downhole well operations. Such operations may include drilling operations or completion operations or even well pad preparation operations.

The transport system first comprises a loading tower. The loading tower is located proximate a loading area.

The transport system also includes a first transfer tower. The first transfer tower is located proximate a transfer area. Additionally, the transport system includes a second transfer tower. The second transfer tower is also located proximate the transfer area.

The transport system additionally includes an unloading tower. The unloading tower is located proximate an unloading area. Preferably, a distance from the loading area to the transfer area is at least one mile, followed by a distance from the transfer area to the unloading area which is also at least one mile.

The transport system further includes a first aerial cable and a second aerial cable. The first aerial cable extends from the loading tower to the first transfer tower, while the second aerial cable extends from the second transfer tower to the unloading tower. Preferably, two or more intermediate towers are placed between the loading tower and the first transfer tower for supporting the first cable and one or more transfer containers above ground. Similarly, two or more intermediate towers may be placed between the second transfer tower and the unloading tower for supporting the second cable and one or more transfer containers above ground.

The transport system also comprises the one or more transfer containers. Each transfer container is configured to be suspended from the first and second aerial cables en route from the loading tower to the unloading tower. Suspension may be by means of a grip assembly. Each grip assembly may comprise one or more rollers or sheaves configured to contact an aerial cable, and a hook. The hook releasably connects to a latching mechanism that suspends a transfer container.

Additionally, the transport system includes a staging area. The staging area is located proximate the one or more well sites undergoing downhole operations.

In one embodiment, the downhole operation comprises formation acidizing. In this instance, the transfer container is configured to hold acid in fluid form.

In another embodiment, the downhole operation comprises formation fracturing. In this instance, the transport system comprises a plurality of transfer containers, with each transfer container being configured to hold frac sand, frac iron, frac chemicals or field personnel. In one aspect, each of the plurality of transfer containers is configured to hold sand to be used as a proppant in the formation fracturing operation. Preferably, the staging area is dimensioned to receive over 100 transfer containers. In one aspect, the unloading area is configured to receive at least 200 transfer containers per day, in series, from the second aerial cable.

In one embodiment, the transport system further comprises a loading area. The loading area is located proximate the loading tower. In this instance, each of the plurality of transfer containers has been loaded with sand prior to or upon arrival at the loading area.

A method of transporting aggregate (or other materials) to a wellsite is also provided. In one aspect, the method includes receiving a plurality of transfer containers at a sand loading area. Beneficially, each of the transfer containers is in modular form.

The method also includes transporting each of the plurality of transfer containers from the sand loading area to a transfer area. This is done in series, via a first aerial cable conveyance system. Of interest, each of the transfer containers is loaded with frac sand (or, optionally, other proppant).

The method additionally includes moving each of the transfer containers from the first aerial cable conveyance system to a second aerial cable conveyance system. The method then includes transporting each of the plurality of transfer containers from the transfer area to an unloading area, in series. This is done via the second aerial cable conveyance system. The first and second aerial conveyance systems may be as described above.

The method also comprises removing the sand from each of the transfer containers. The sand is used in connection with a wellbore fracturing operation.

Preferably, each of the plurality of transfer containers is delivered to the loading area by means of a truck. Each of the transfer containers is configured to be loaded onto the truck by means of a fork lift. The transfer containers are preferably pre-loaded with frac sand upon arrival at the loading area. The method then further comprises: securing each of the plurality of transfer containers to a cable associated with the first cable conveyance system; and upon arrival at the transfer area, securing each of the plurality of transfer containers to a cable associated with the second cable conveyance system. Securing the transfer containers to the respective cables is preferably done by latching each of the transfer containers to the cables using a hook.

It is noted that removal of sand from each of the transfer containers results in a plurality of empty transfer containers at the unloading area. This being the case, the method may further comprise: transporting each of the empty transfer containers from the unloading area back to the transfer area, in series, via the second aerial cable conveyance system; and upon arrival at the transfer area, transporting each of the empty transfer containers from the transfer area back to the loading area, in series, via the first aerial cable conveyance system.

A method of transporting supplies to a wellsite is also provided herein. In one embodiment, the method first comprises receiving a plurality of transfer containers. The transfer containers are received at a loading area.

The method also includes securing each of the plurality of transfer containers to a first cable. The cable resides along a first aerial cable conveyance system. The method then includes transporting each of the plurality of transfer containers along the first cable, in series, from the loading area to a transfer area.

The method further includes securing each of the plurality of transfer containers to a second cable. The second cable resides along a second aerial cable conveyance system. The method then includes transporting each of the plurality of transfer containers along the second cable, in series, from the transfer area to an unloading area.

It is observed that the first and second aerial conveyance systems may be as described above. It is further observed that more than one transfer container may be transported along a cable, in series, at any given time.

The method also comprises placing each of the transfer containers at a staging area. The staging area is located proximate one or more well sites, wherein the one or more well sites is undergoing downhole operations. The staging area is preferably in proximity to or is the same as the unloading area.

Preferably, the downhole operations comprise formation fracturing. In this instance, each transfer container may be configured to hold frac sand, frac iron, frac chemicals or field personnel. In one aspect, each of the plurality of transfer containers is configured to hold sand to be used as proppant in the formation fracturing operation, and serve as sand boxes. Preferably, each of the sand boxes has been pre-loaded with sand prior to arrival at the loading area, and is then unloaded at the staging area.

Preferably, the unloading area (which may be a staging area at a wellsite) is dimensioned to receive over 50 transfer containers. In one aspect, the unloading area is configured to receive at least 100 transfer containers per day, in series, from the second aerial cable.

The transfer containers are configured to be suspended from the first and second aerial cables so as to be transported from a loading tower to an unloading tower. Suspension may be by means of a grip assembly. Each grip assembly may comprise one or more rollers configured to move across an aerial cable. Alternatively, each grip assembly may comprise sheaves housed within a block to contact and support the cable. A latching mechanism is configured to releasably connect to and support a transfer container. In one aspect, each of the transfer containers is supported from a cable by means of a hook dimensioned to receive a latching mechanism.

Preferably, the transport system includes a plurality of second aerial conveyance systems. Each second aerial conveyance system terminates at a different unloading area associated with its own staging area. The first aerial conveyance system is designed to deliver transfer containers to the transfer area. From there, the operator selects a second aerial conveyance system to deliver the transfer containers to a selected unloading area.

BRIEF DESCRIPTION OF THE DRAWINGS

So that the manner in which the present inventions can be better understood, certain illustrations, charts and/or flow charts are appended hereto. It is to be noted, however, that the drawings illustrate only selected embodiments of the inventions and are therefore not to be considered limiting of scope, for the inventions may admit to other equally effective embodiments and applications.

DETAILED DESCRIPTION OF CERTAIN EMBODIMENTS

Definitions

Figure 1:
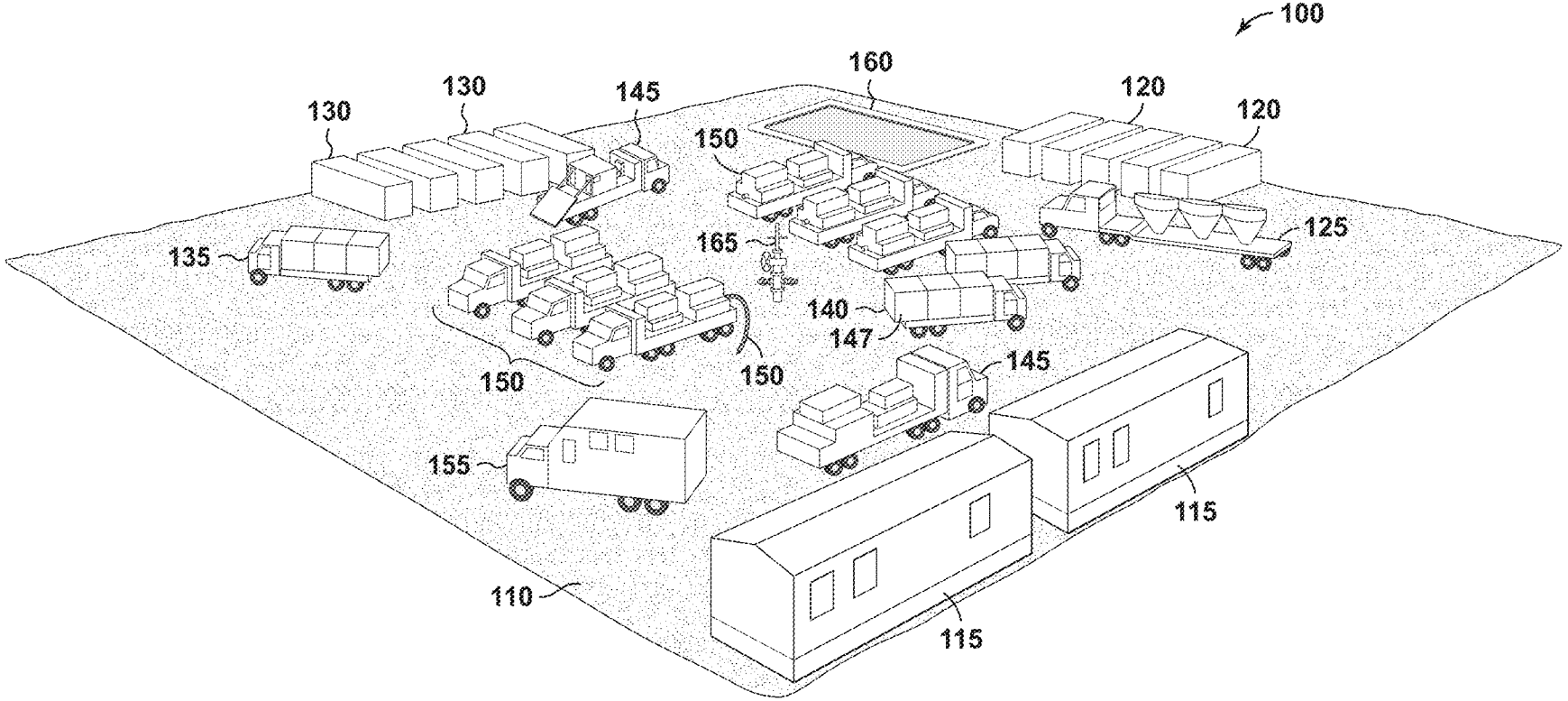
FIG. 1 (Prior Art)
FIG. 1 is a schematic view of a known well site. The well site is set up to conduct a hydraulic fracturing operation.

Various terms as used in the specification and in the claims are defined below. To the extent a term used in the claims is not defined below, it should be given the broadest reasonable interpretation that persons in the upstream oil and gas industry have given that term as reflected in at least one printed publication or issued patent.

For purposes of the present application, it will be understood that the term "hydrocarbon" refers to an organic compound that includes primarily, if not exclusively, the elements hydrogen and carbon. Hydrocarbons may also include other elements such as, but not limited to, halogens, metallic elements, nitrogen, oxygen, and/or sulfur.

As used herein, the term "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions, at processing conditions, or at ambient condition. Hydrocarbon fluids may include, for example, oil, natural gas, coalbed methane, shale oil, pyrolysis oil, pyrolysis gas, a pyrolysis product of coal, and other hydrocarbons that are in a gaseous or liquid state, or combination thereof.

As used herein, the terms "produced fluids," "reservoir fluids" and "production fluids" refer to liquids and/or gases removed from a subsurface formation, including, for example, an organic-rich rock formation. Produced fluids may include both hydrocarbon fluids and non-hydrocarbon fluids. Production fluids may include, but are not limited to, oil, natural gas, pyrolyzed shale oil, synthesis gas, a pyrolysis product of coal, oxygen, carbon dioxide, hydrogen sulfide and water.

As used herein, the term "fluid" refers to gases, liquids, and combinations of gases and liquids, as well as to combinations of gases and solids, combinations of liquids and solids, and combinations of gases, liquids, and solids.

As used herein, the term "subsurface" refers to geologic strata occurring below the earth's surface.

As used herein, the term "formation" refers to any definable subsurface region regardless of size. The formation may contain one or more hydrocarbon-containing layers, one or more non-hydrocarbon containing layers, an overburden, and/or an underburden of any geologic formation. A formation can refer to a single set of related geologic strata of a specific rock type, or to a set of geologic strata of different rock types that contribute to or are encountered in, for example, without limitation, (i) the creation, generation and/or entrapment of hydrocarbons or minerals, and (ii) the execution of processes used to extract hydrocarbons or minerals from the subsurface.

The term "sand" refers to any granular material containing quartz or silica (meaning a combination of silicon and oxygen, or $SiO_2$). Non-limiting examples include "Northern White" sand and or West Texas eolian sand. Sand is one form of proppant that may be used in a formation fracturing operation.

The term "aggregate" refers to an inorganic mixture containing sand.

As used herein, the term "wellbore" refers to a hole in the subsurface made by drilling or insertion of a conduit into the subsurface. A wellbore may have a substantially circular cross section. The term "well," when referring to an opening in the formation, may be used interchangeably with the term "wellbore."

A "well site" is a surface area where a wellbore is being or has been formed.

Description of Selected Specific Embodiments

Described herein is a transport system used to convey frac sand or other material. Also described are methods for transporting frac sand for use in wellbore fracturing operations.

FIG. 1 is a schematic view of a well site 100 undergoing a completion operation. More specifically, the well site 100 is undergoing a high-pressure fluid injection operation. The operation may include an acid treatment of a subsurface formation. However, the operation principally represents a hydraulic fracturing operation.

The well site 100 is placed on a so-called well pad 110. The well pad 110 represents an area where the ground surface has been prepared for drilling and completion operations. The pad 110 may be, for example, two to four acres. In some cases, more than one well may be drilled and completed on a single pad, with each well being completed in the same horizontal plane but in a different azimuth, or optionally along different horizontal planes.

The well site includes a series of sand bins 120. The sand bins 120 may be trailers carried to the well pad 110 using trucks. The sand bins 120 may be pre-filled with sand, or may be filled with sand using a separate sand truck 125. Alternatively, the sand bins 120 may actually each be a sand truck.

The well site also includes a frac tree 165. The frac tree 165 is disposed over a wellbore (not shown) and includes a series of vertically-stacked flow control valves. The flow control valves control the high-pressure injection of fracturing fluids into the wellbore. It is understood that the current inventions are not limited by the architecture of the well tree or the nature of well completion.

The well site 100 also includes frac storage tanks 130. The frac storage tanks 130 have been brought on location 110 using trucks. In one aspect, the frac storage tanks 130 represent trailers having water tanks that are brought to the location 100 by trucks. More preferably, the frac storage tanks 130 are stationary tanks that are filled by water transport trucks 135. In either instance, the tanks 130 contain water (typically brine) used as the carrier medium for the injection fluid.

FIG. 1 also shows that chemical storage trucks 140 have been driven onto the pad 110. The chemical storage trucks 140 carry surfactants or other chemicals (typically referred to as "slickwater") that are mixed with the brine of the frac storage tanks 130 to reduce friction. The chemicals may also optionally include biocides, scale inhibitors and stabilizers as well as guar gum, which is used as a thickening agent. The chemicals are mixed along with sand into the brine using so-called frac blenders 145.

The well site 100 of FIG. 1 also shows a series of frac pumps 150. Each of the frac pumps 150 is preferably part of a truck that is configured to receive injection fluids from frac blenders 145, and then send the fluids under high pressure through a high-pressure injection line (shown partially at 150) In some cases, the frac pumps deliver the slurry to a so-called frac missile (not shown). A service truck 155 may be used to provide tools and equipment such as so-called frac iron. It is understood that FIG. 1 is merely illustrative; the inventions herein are not limited to an exact arrangement of trucks, pumps, tanks, blenders or frac iron.

As noted, between the frac pumps 150 and the frac tree 165 is a high pressure injection line 150. A pressure relief valve (not shown) is typically provided along the injection line 150. In the event a pressure is detected along the high-pressure injection line 150 that exceeds a designated threshold pressure, the pressure relief valve (or "frac relief valve" or "FRV") is opened. Injection fluids are then diverted to an open relief pit 160.

In an actual hydraulic "fracking" operation, fluids are pumped into different longitudinal portions of a horizontal wellbore in stages. In addition, a series of different fluids may be pumped into each stage, including for example an acid stage, a slickwater stage (having no proppant), a proppant stage and a flushing stage. This application is not intended to be a primer on hydraulic fracturing, and the person of ordinary skill in the art will be familiar with the fracking process. For purposes of the present disclosure, all of these fluids, individually and together, are considered "injection fluids" or "fracturing fluids."

Current completion operations operate under the principle that "more sand is better." It is estimated that a standard horizontal well now uses between 1,900 pounds (nearly 1 ton) and 3,000 pounds (1.5 tons) of sand per lateral foot. A 10,000 foot lateral well may consume 12 million to 25 million pounds (6,000-12,500 tons) of proppant, which is mixed into a water-based slurry using mixers and blenders. While only a few illustrative sand bins/trailers 120 are shown, it is understood that a fracturing operation for a 10,000 foot lateral well may require a delivery of sand by over 450 trucks. A single frac crew can place downhole 4 million pounds or more of sand in a day, emptying 100 dry bulk trailers every 24 hours.

The last-mile logistics for moving frac sand involves transportation by heavy truck haulers, each carrying approximately 22.5 tons of sand. As discussed in detail above, the delivery of sand and other materials to a well site 110 causes considerable strain upon state and county roads and resources. Sand delivery by truck is expensive and contributes to road infrastructure deterioration and traffic congestion. In addition, sand hauling via truck requires a large number of drivers that are currently in short supply in the United States. Therefore, an improved proppant delivery system is needed, particularly in wells being completed in such areas as the Delaware Basin, the Midland Basin and the Bakken Shale.

Figure 2:
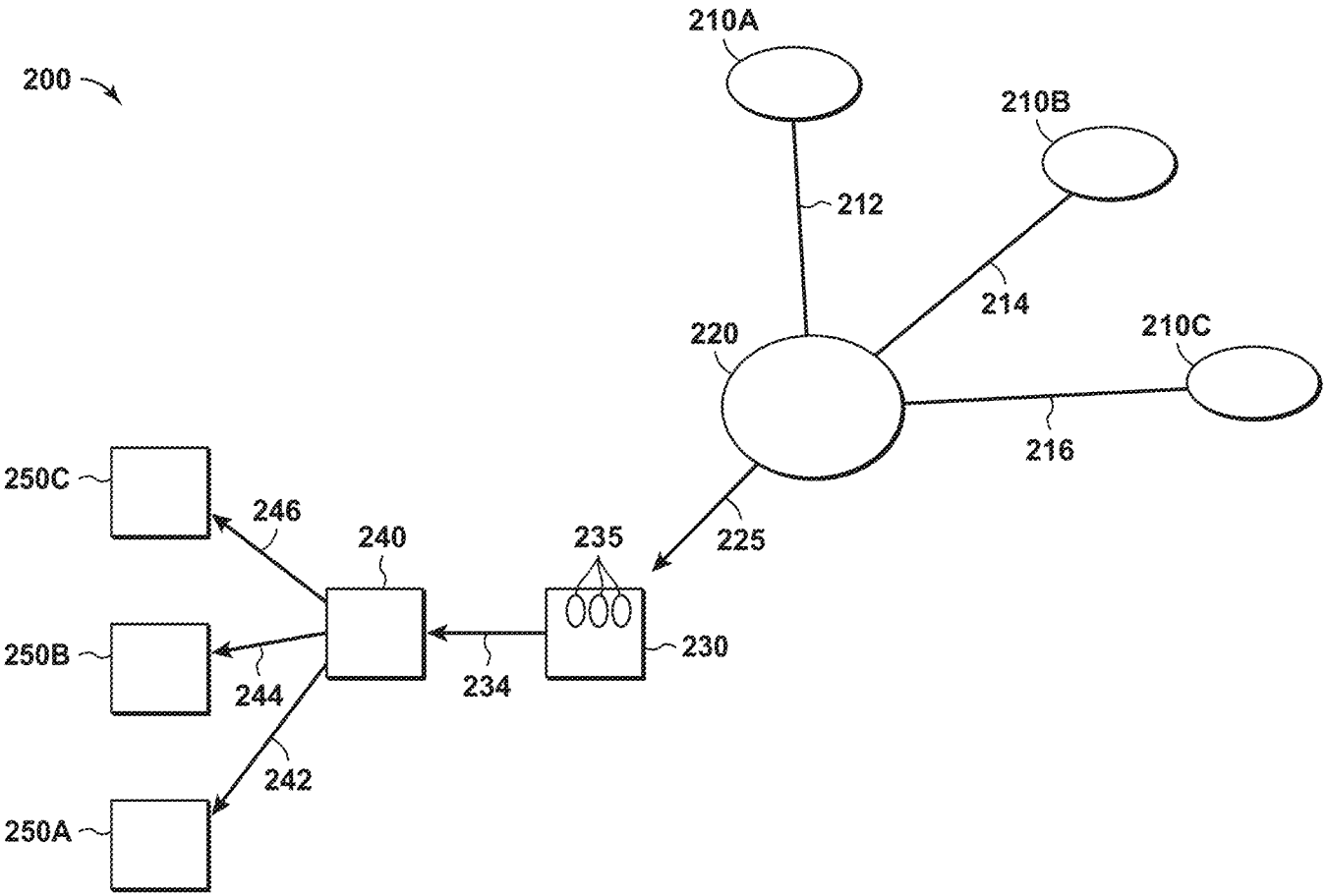
FIG. 2 is a schematic view of a sand logistics operation of the present invention, in one embodiment. Sand is transported from one of several mines, to a loading area for distribution to well sites.

FIG. 2 is a schematic view of a logistics map 200 for transporting sand to various well sites 100 according to the present invention, in one embodiment. The intent is to reduce the number of transport vehicles needed incident to well completion activities, particularly in connection with hydraulic fracturing and other well completion operations.

The logistics map 200 first shows a plurality of sand sources, or "mines" 210. Specifically, three illustrative mines 210A, 210B and 210C are shown. Each mine 210A, 210B, 210C represents an area where a permit has been issued to extract sand suitable for formation proppant. Appropriate leases have been obtained from the land owners, or the land has been purchased by mining companies.

The sand mines 210A, 210B, 210C may be adjacent to one another or may be located in different counties. Indeed, they may even be located in different states. In any event, the sand is procured and then transported to a processing facility 220. The processing facility 220 is used to filter rocks and larger aggregate (and any organic matter), leaving behind quartz or silica of a desirable mesh size.

For sand mine 210A, the sand is transported via line 212; for sand mind 210B, the sand is transported via line 214; and for sand mine 210C, the sand is transported via line 216. Lines 212, 214 and 216 may represent short conveyor systems. Alternatively, they may represent railroad spurs or perhaps longer rail lines. Alternatively still, lines 212, 214, 216 may be county roads or interstate highways, with the sand being carried in over-the-road trailers via Full-Truck-Load (or "FTL) trucks. In any instance, the sand is filtered and processed at the processing facility 220 and is ready for delivery to an area where oilfield operations are taking place.

In the map 200 of FIG. 2, the filtered sand is transported to a receiving area 230. Transport is made via line 225, which typically includes a plurality of over-the-road trucks carrying trailers or, in some instances, boxes of sand. Upon arrival, a series of sand bins or silos 235 are provided for temporary storage. It is understood that in many areas where sand might be held (such as western North Dakota, eastern New Mexico or West Texas), ambient wind can actually blow the sand away. Therefore, the sand is typically held in bins or silos 235. Alternatively, the sand may be held in closed-top containers.

In the present methods, the receiving area 230 serves as a loading station. Many well completion operations are conducted in remote locations. Therefore, it is preferred that the receiving area 230 be located near a truck stop, or near a rural gas station and restaurant.

From the receiving area, sand is carried to a transfer area 240 via line 234. From there, the sand is delivered to any of a plurality of unloading areas 250A, 250B, 250C. Each unloading area is preferably associated with a well site, such as well site 100 of FIG. 1, the exception being that far fewer sand bins 120 or sand delivery trucks 125 are required.

The logistics map 200 shows separate lines for transporting sand from the transfer area 240 to the unloading areas 250A, 250B, 250C. Sand is transported to unloading area 250A via line 242. Similarly, sand is transported to unloading area 250B via line 244. Similarly still, sand is transported to unloading area 250C via line 246.

In order to reduce or even eliminate the use of delivery trucks 125 to the well sites 250A, 250B, 250C, line 234 is provided as an aerial cable conveyance system. Similarly, lines 242, 244 and 246 also represent aerial cable conveyance systems. The aerial conveyance systems transport large cargo boxes, referred to herein as "transfer containers," via respective cables. The cables cross over roads and greatly eliminate congestion on state and county highways while expediting delivery of proppant, materials and even personnel to well sites.

Figure 3A:
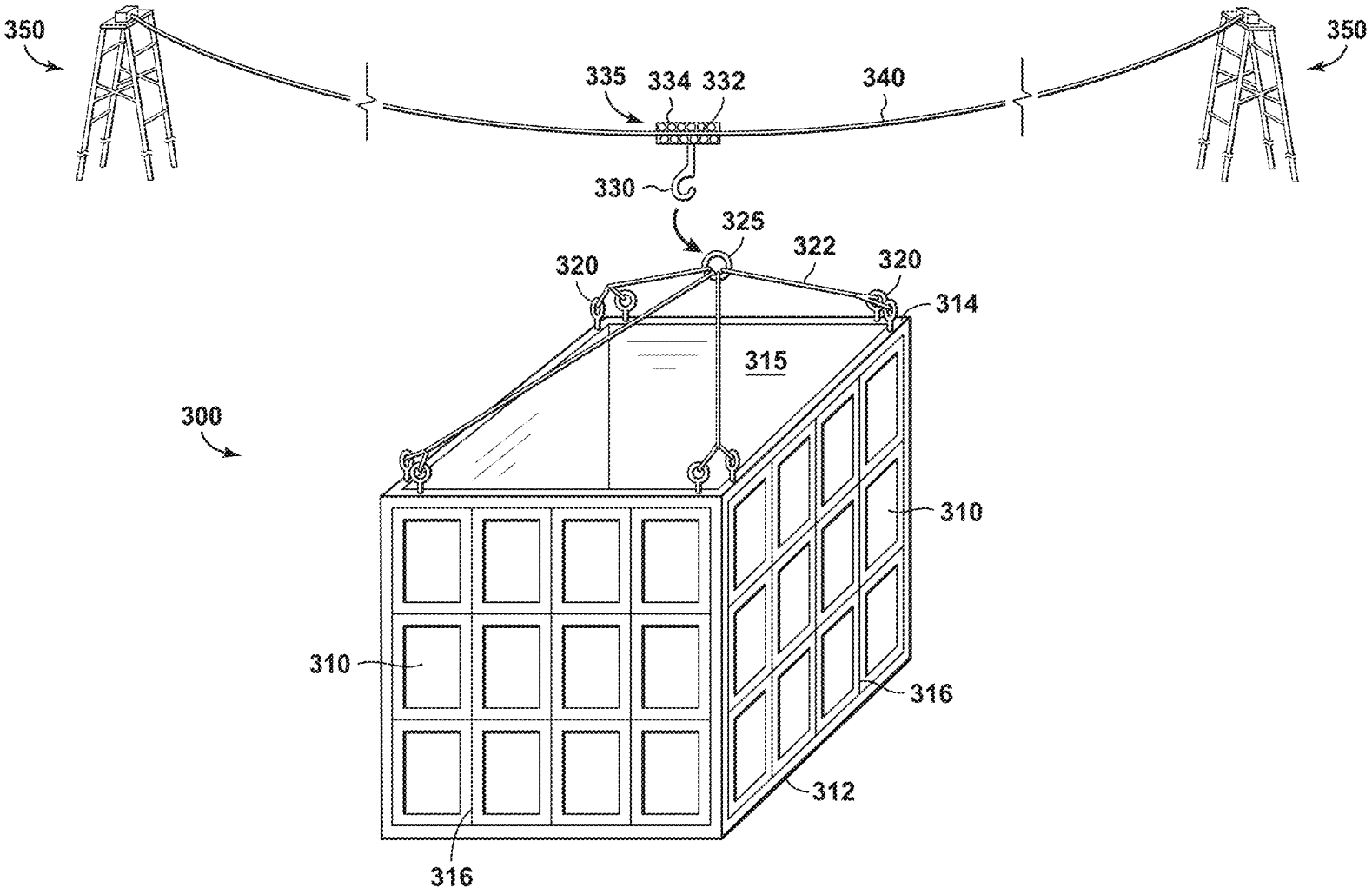
FIG. 3A is a perspective view of a transfer container as may be used in the transport system of the present invention, in one embodiment.

FIG. 3A is a perspective view of a transfer container 300 as may be used in a transport system of the present invention, in one embodiment. (A transport system is shown schematically in FIG. 4). The transfer container 300 represents a cargo box having four sides 310 and a base 312. Preferably, each container 300 has a normally-closed top having a hatch for opening during sand loading, and has a gate at the base 312 for sand unloading. An internal compartment 315 is formed by the sides 310 and the base 312. Various support rails 316 are placed along the sides 310 providing structural integrity.

In one embodiment, the transfer container 300 is 10 feet by 5 feet, or other dimension providing for a volume of about 500 $ft^3$. When substantially full of sand, the transfer container 300 may weigh 45,000 to 50,000 pounds or more. Accordingly, the support rails 316 are fabricated from an extremely durable material such as steel, carbon-fiber material or graphite fiber material.

Figure 3B:
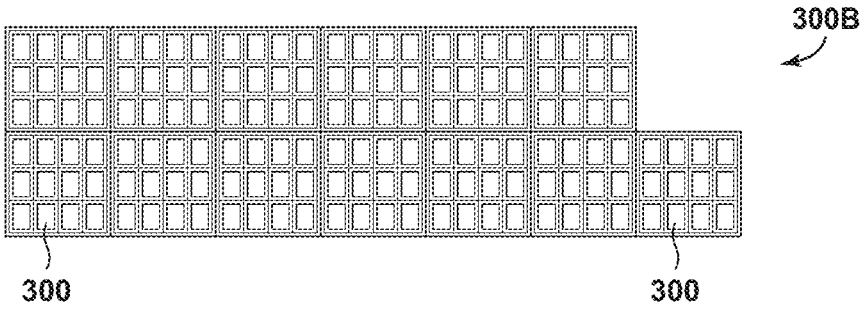
FIG. 3B is a side view of a plurality of transfer containers, formed as individual and stackable modules.

The transfer container 300 is designed to be stackable and scalable. FIG. 3B is a side view of a plurality of transfer containers 300B, in stacked relation. The individual transfer containers 300 may be moved and stacked using a fork lift.

Figure 3C:
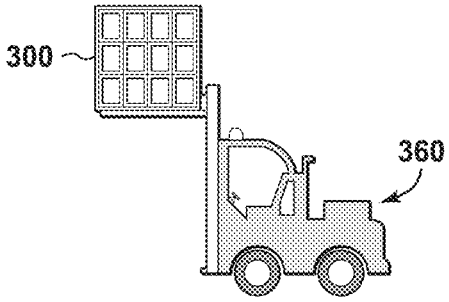
FIG. 3C is a side view of a single illustrative transfer container. Here, the transfer container is being lifted and moved via forklift.

FIG. 3C is a side view of a single illustrative transfer container 300. Here, the transfer container 300 is being lifted and moved via forklift 360. The fork lift 360 may stack boxes 300B, or may move boxes 300 onto a trailer for delivery.

Figure 3D:
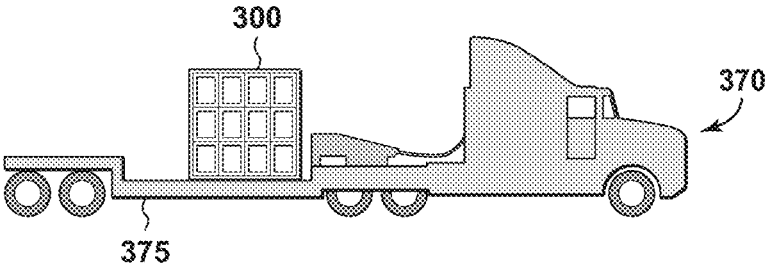
FIG. 3D is a somewhat schematic side view of a truck delivering a transfer container to a loading area. The transfer container has been loaded onto a trailer of the truck using the fork lift of FIG. 3C.

FIG. 3D is a schematic side view of a truck 370. The truck 370 includes a flatbed trailer 375 hitched there behind. In this view, a transfer container 300 has been loaded onto the trailer 375 such as by using the fork lift 360 of FIG. 3C. It is understood that a flatbed trailer 375 may be dimensioned to carry multiple transfer containers 300.

Returning to FIG. 3A, the transfer container 300 is designed to be hoisted and then carried along a cable 340. Hoisting may be done using a winch line or by the fork lift 360. In the illustrative arrangement of FIG. 3A, a latching system is provided. The latching system includes a series of eye bolts 320 and a series of support cables 322. The cables 322 all lead to a central eye bolt 325. The central eye bolt 325, in turn, is picked up by a hook 330 for latching.

There are, or course, various alternative latching systems for the hook 330 to capture the transfer container 300. The current inventions are not limited to any particular means for supporting and carrying a transfer container 300 along the cable 340 unless so expressly stated in the claims. For purposes of the present disclosure, any such means may be referred to as latching. Thus, securing each of the plurality of transfer containers 300 to a cable 340 and hook 330 comprises latching each of the transfer containers 300 to the cable 340.

It is noted in FIG. 3A that a pair of opposing towers 350 is shown. The towers 350 support and suspend the cable 340. The towers 350 may be, for example 0.25 km apart, or 0.5 km apart, or up to 1 km apart. The towers 350 are configured to allow the hook 330 to carry transfer containers 300 from tower 350 to tower 350, with the towers 350 leading to designated areas that are part of a transport system.

To facilitate the transfer of transfer containers 300 from tower 350 to tower 350, a grip assembly 335 is provided. The grip assembly 335 includes a plurality of wheels 332 residing above and below the cable 340. The wheels 332 ride along the cable 340 and are held within a block 334. The block 334, in turn, supports the hook 330.

To move the transfer containers 300 from tower 350 to tower 350, an electrical power source is provided. The electrical power source may be an on-board battery, or a combination of a battery and a capacitor. Alternatively, the power source may be a power cable (not shown) that is suspended between the towers 350 adjacent the cable 340. Alternatively still, the cable 340 itself may be electrified. In this instance, the hook 330 and block 334 will preferably be heavily insulated. In any instance, $CO_2$ emissions will be reduced by reducing the number of large trucks traversing the highways and idling en route to well sites.

Some combination of these power sources may be considered. In any instance, power is supplied to on-board motors (not shown) associated with the wheels 332. Specifically, a plurality of small motors (not shown) may be provided along the block 334. The motors rotate shafts connected to the respective wheels 332. The shafts cause the wheels 332 to turn, moving the block 334 and suspended transfer containers 300 along the cable 340, from tower 350 to tower 350.

As an alternative, the cable 340 may be a looping steel cable. In this instance, the steel cable 340 moves across sheaves (not shown) placed between and along the towers 350. In this instance, the cable 340 is driven by a bullwheel (not shown) located in a terminal. The bullwheel, in turn, is driven by an electrical motor or a combustible engine. The block 334 and connected hook 330 are then fixed along the cable 340. In other words, the cable 340 moves the hook 330 rather than the hook 330 self-conveying along the cable 340.

It is understood that the present inventions are not limited by the mechanical and electrical systems used for transporting the transfer containers 300 along the cable 340 unless so expressly stated in the claims.

Figure 4:
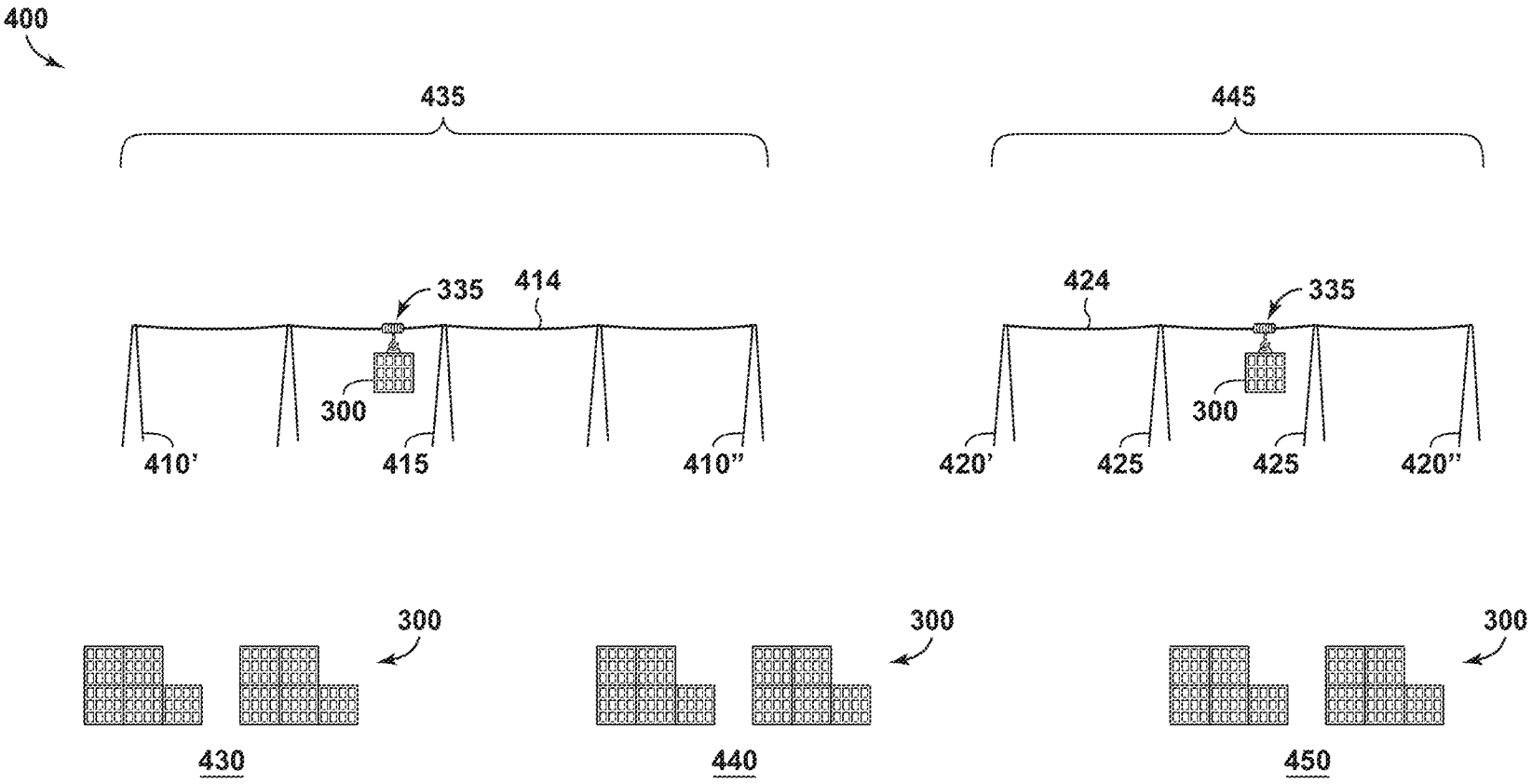
FIG. 4 is a side view of an illustrative transport system of the present invention, in one embodiment. Stackable, portable and modular transfer containers are shown at a loading area, a transfer area and an unloading area.

FIG. 4 is a side view of an illustrative transport system 400 of the present invention, in one embodiment. The transport system 400 is designed to carry transfer containers 300 across cables 414, 424. One illustrative transfer container 300 is shown being supported by each of cables 414 and 424. However, it is understood that each cable 414, 424 may and likely will transport a plurality of transfer containers 300, in series, at the same time.

Each cable 414, 424 is associated with a separate aerial cable conveyance system. Cable 414 is associated with a first aerial cable conveyance system 435, while cable 424 is associated with a second aerial cable conveyance system 445. The first aerial cable conveyance system 435 moves transfer containers 300 from a receiving area 430 to a transfer area 440. Similarly, the second aerial cable conveyance system 445 moves transfer containers 300 from the transfer area 440 to an unloading area 450.

The receiving area 430 may be, for example, the sand gathering area 230 of FIG. 2. Similarly, the unloading area 450 may be any of the unloading areas 250A, 250B or 250C of FIG. 2.

A plurality of transfer containers 300 are seen in each of the receiving area 430, the transfer area 440 and the unloading area 450. The illustrative transfer containers 300 are stackable, portable and modular. Preferably, each transfer container 300 is designed to hold frac sand. Preferably, the transfer containers 300 arrive at the receiving area 430 pre-loaded with the frac sand.

It is understood that the transfer containers 300 may be configured to carry other supplies. Such other supplies may include chemicals, water, pumps, cleaning supplies, personal supplies, frac iron or oilfield tubulars. Indeed, the transfer containers 300 may even be configured to transport personnel and food across job sites.

The first aerial cable conveyance system 435 includes a loading tower 410' and a transfer tower 410". The towers 410', 410" support the cable 414. The loading tower 410' is proximate the loading area 430, while the transfer tower 410" is proximate the transfer area 440. Intermediate the two towers 410', 410" is a plurality of intermediate towers 415. The number of intermediate towers 415 is a function of the distance between towers 410' and 410" and the loads to be borne by the cable 414.

The second aerial cable conveyance system 445 includes a transfer tower 420' and an unloading tower 420". The towers 420', 420" support the cable 424. The transfer tower 420' is proximate the loading area 430, while the unloading tower 420" is proximate the unloading area 450. Intermediate the two towers 420', 420" is a plurality of intermediate towers 425. The number of intermediate towers 425 is also a function of the distance between towers 420' and 420" and the loads to be borne by the cable 414.

Figure 5:
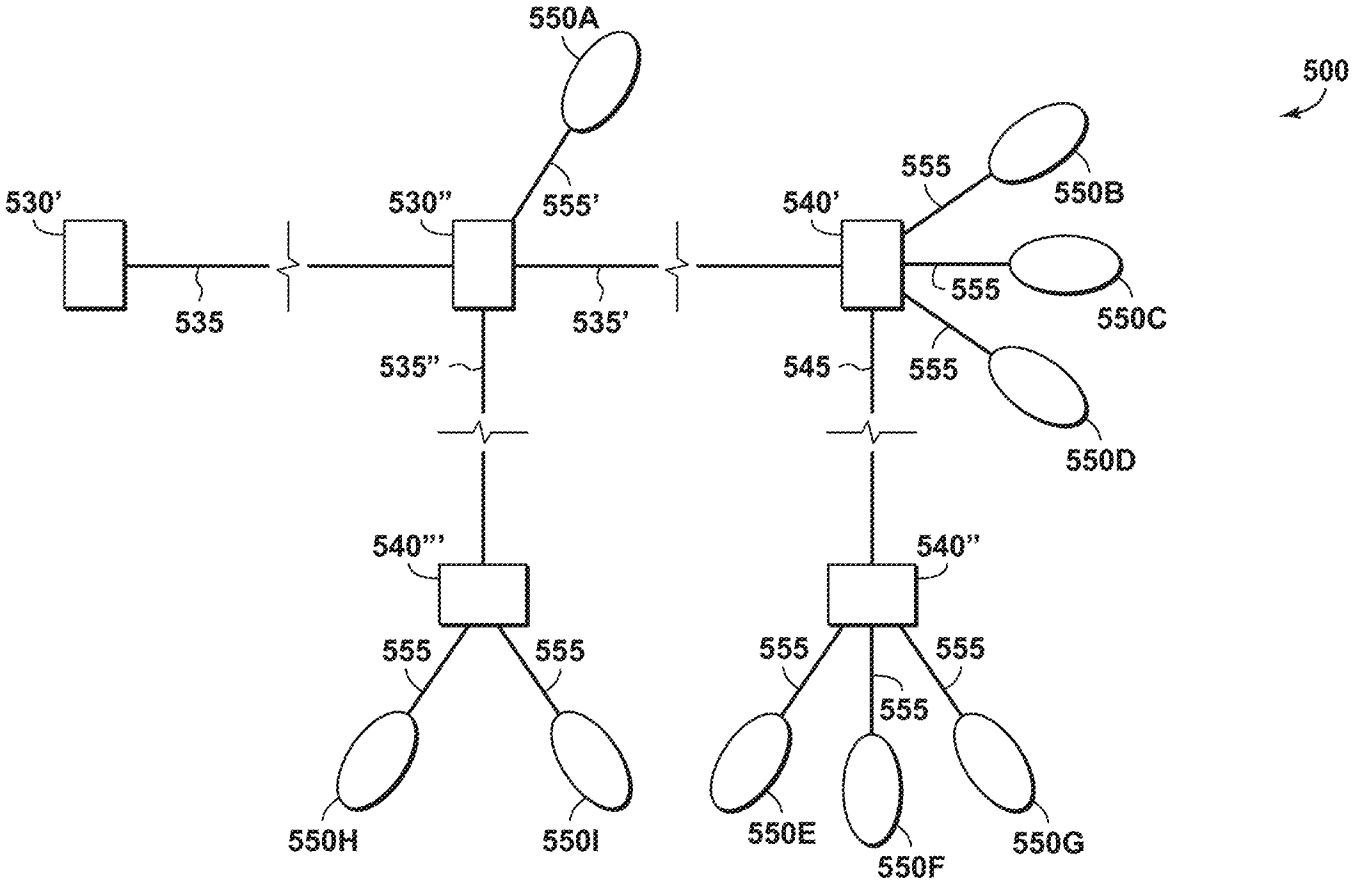
FIG. 5 is a schematic view of a transport system of the present invention, in an alternate embodiment.

FIG. 5 is a schematic view of a transport system 500 of the present invention, in an alternate embodiment. FIG. 5 is provided to demonstrate that a transport system for moving frac sand or other supplies may be networked as between a plurality of well sites.

First, the transport system 500 includes a first receiving area 530'. The first receiving area 530' is designed and configured to receive transfer containers 300. The transfer containers 300 may or may not be pre-loaded with frac sand or other equipment and supplies.

The transport system 500 next includes a second receiving area 530". The second receiving area 530" is designed and configured to receive transfer containers 300 from the first receiving area 530'. The transfer containers 300 are moved from the first receiving area 530' to the second receiving area 530" by means of line 535. When moved across line 535, the transfer containers 300 will be loaded with proppant, water, chemicals or supplies.

From the second receiving area 530, transfer containers 300 may be moved to either of two selected transfer areas 540', 540'". Some selected transfer containers 300 are delivered to transfer area 540' by means of line 535'. At the same time, other selected transfer containers 300 are delivered to transfer area 540'" by means of line 535".

Each of transfer areas 540', 540'" is configured to receive transfer containers 300, and then hold the boxes 300 for delivery to selected unloading areas 550. In the arrangement of FIG. 5, transfer area 540' serves as a transfer area for the delivery of transfer containers 300 to any of unloading areas 550B, 550C or 550D. Similarly, transfer area 540'" serves as a transfer area for the delivery of transfer containers 300 to either of unloading areas 550H or 5501. These transports are made by lines 555.

It is noted that receiving area 530" may also be used as a transfer area. In this respect, transfer containers 300 may be moved from area 530" directly to an unloading area 550A. This is done via a line 555'. Additionally, it is noted that unloading area 540' may also function as a transfer area. Using line 545, transfer containers 300 may be moved to transfer area 540", which then delivers transport boxes 300 to any of selected unloading areas 550E, 550F or 550G.

Each of lines 535, 535' and 535" represents a first aerial cable conveyance system, indicative of cable conveyance system 235 of FIG. 2. Likewise, each of lines 555 represents an aerial cable conveyance system, indicative of any of cable conveyance systems 242, 244, 246 of FIG. 2.

Finally, each of the unloading areas 550 is intended to be associated with a well site. The well site may be a single well where completion operations are being conducted. Alternatively, the well site may be a multi-well pad where drilling and completion operations (or downhole well operations generally) are being conducted. Preferably, the completion operations include formation fracturing operations.

Figure 6:
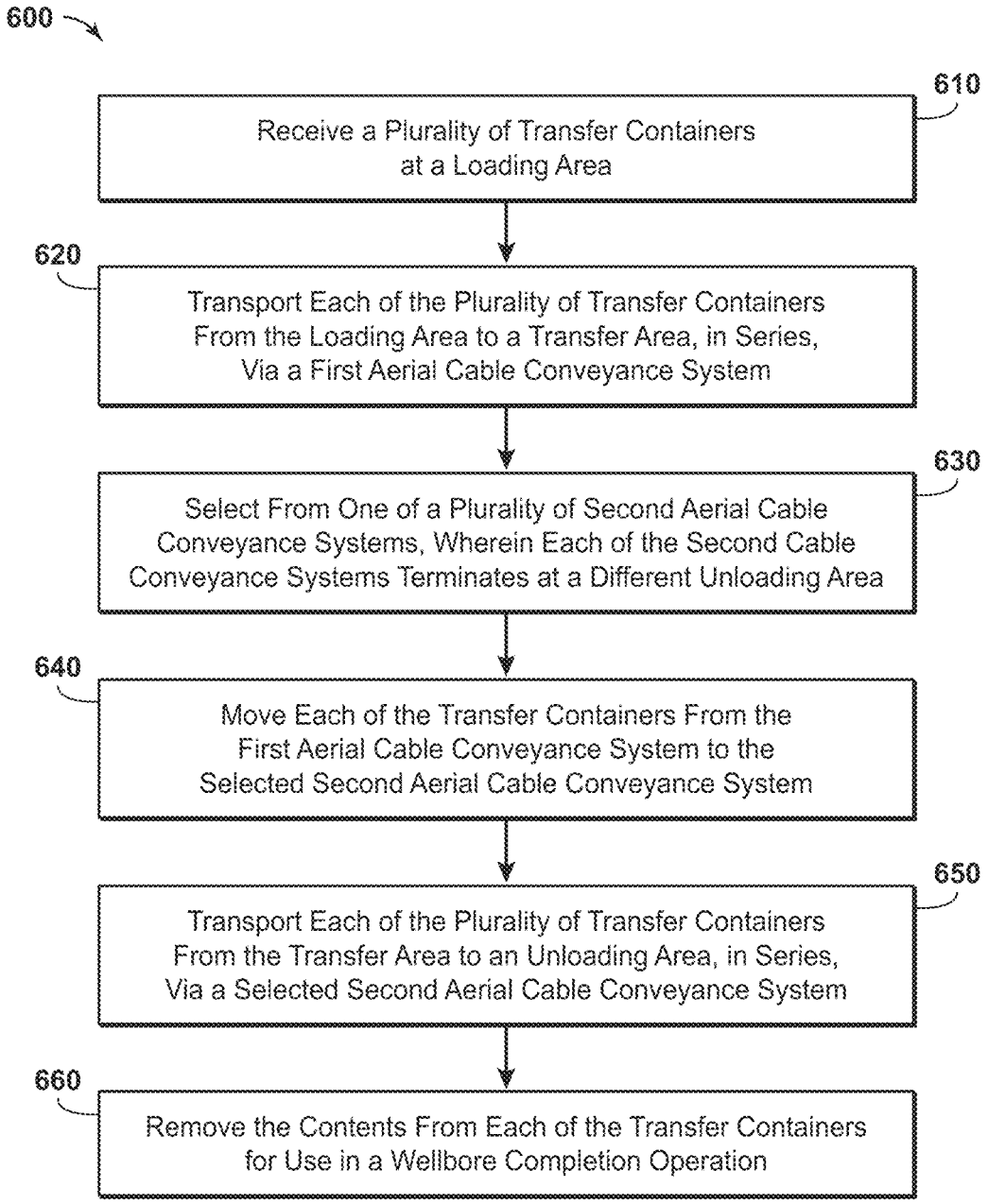
FIG. 6 is a flow chart showing steps for a method of transporting materials or personnel to selected well sites.

Based on the sand transport systems 200, 400 and 500 described above, a method of using a transport system is provided herein. FIG. 6 is a flow chart showing steps for a method 600 of transporting materials or personnel to well sites, in one embodiment. More specifically, a method for transporting proppant in support of a wellbore operation is provided.

The method 600 first includes receiving a plurality of transfer containers. This is shown in Box 610. The transfer containers are received at a loading area. In one aspect, each of the transfer containers is delivered to the loading area by means of a truck. Preferably, each of the transfer containers is in modular form, making it movable and stackable using a fork lift. In a preferred embodiment, the transfer containers are pre-loaded with an aggregate such as frac sand. In this instance, the loading area is a sand loading area.

The method 600 also includes transporting each of the plurality of transfer containers from the loading area to a transfer area. Transport is done in series via a first aerial cable conveyance system. This is shown in Box 620.

In one aspect, the method 600 also comprises selecting from one of a plurality of second aerial cable systems. This is provided in Box 630. Each of the second aerial cable conveyance systems terminates at a different unloading area. Each unloading area, in turn, is associated with a respective well site.

The method 600 additionally includes moving each of the transfer containers from the first aerial cable conveyance system to the selected second aerial cable conveyance system. This is indicated at Box 640. This transfer is preferably done using one or more fork lifts, although other conveyance means such as cranes may be used.

The method 600 then includes transporting each of the plurality of transfer containers from the transfer area to an unloading area, in series. This step is seen in Box 650. The step of Box 650 is done via a selected second aerial cable conveyance system.

The first and second aerial conveyance systems may be as described above. In this respect, the first aerial cable extends from a first loading tower located at the receiving area to a first transfer tower located at the transfer area. At the same time, the second aerial cable extends from a second transfer tower at the transfer area to an unloading tower at an unloading area.

Preferably, two or more intermediate towers are placed between the loading tower and the first transfer tower for supporting the transfer containers above ground. Similarly, two or more intermediate towers may be placed between the second transfer tower and the unloading tower for supporting the transfer containers above ground. Preferably, a distance from the loading area to the transfer area is at least one mile (1.61 km), while a distance from the transfer area to a selected unloading area is also at least one mile (1.61 km).

The method 600 also comprises removing the sand from each of the transfer containers. This is shown at Box 660. The sand (or other contents) is preferably used in connection with a wellbore fracturing operation.

It is noted that the removal of sand from each of the transfer containers results in a plurality of empty transfer containers at an unloading area. Accordingly, the method 600 may further comprise, following removal of the sand (or other contents) from each of the transfer containers: transporting each of the empty transfer containers from the unloading area back to the transfer area, in series, via the second aerial cable conveyance system; and upon arrival at the transfer area, transporting each of the empty transfer containers from the transfer area back to the loading area, in series, via the first aerial cable conveyance system. In this way, the transfer containers may be "recycled."

As can be seen, an improved method for transporting aggregate in support of a downhole well operation is provided. Although the transport system and the transport methods have been described in the present disclosure primarily with respect to moving frac sand, the system and methods may be used to transport other supplies or personnel in support of wellbore drilling and completion operations. For example, the transfer containers may contain frac chemicals, water/brine, drilling mud, pumps, cleaning supplies, personal supplies for service personnel or frac iron. The transfer containers may be used to transport acid in fluid form in support of a downhole acid treatment operation. In addition, selected transfer containers may be used to transport field personnel.

It is anticipated that the first and second aerial cables described herein may traverse across farm-to-market roads, county roads, streams, farms and pasture. In some instances, an aerial cable may pass through a town or cross over a freeway, though this is certainly not preferred.

INDUSTRIAL APPLICABILITY

The systems and methods disclosed herein are applicable to the oil and gas industries.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions, and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements, and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

We claim:

1. A method of transporting supplies to a wellsite, comprising:

transporting each of a plurality of transfer containers from a loading area to a transfer area, in series, via a first aerial cable conveyance system;

selecting from one of a plurality of second aerial cable conveyance systems, wherein each of the second aerial cable conveyance systems terminates at a different unloading area;

moving each of the plurality of transfer containers from the first aerial cable conveyance system to the selected second aerial cable conveyance system;

transporting each of the plurality of transfer containers from the transfer area to the unloading area of the selected second aerial cable conveyance system, in series; and placing each of the plurality of transfer containers at a staging area located proximate one or more well sites, wherein the one or more well sites is undergoing formation fracturing operations.

2. The method of claim 1, wherein:

the first aerial cable conveyance system comprises:

a loading tower located proximate the loading area;

a first transfer tower located proximate the transfer area;

two or more intermediate towers placed between the loading tower and the first transfer tower; and a first aerial cable extending from the loading tower, across the two or more intermediate towers, and the first transfer tower for supporting the transfer container above ground; and each of the second aerial cable conveyance systems comprises:

a second transfer tower located proximate the transfer area;

an unloading tower located proximate the unloading area;

two or more intermediate towers placed between the second transfer tower and the unloading tower; and a second aerial cable extending from the second transfer tower, across the two or more intermediate towers, and the unloading tower for further supporting the transfer containers above ground.

3. The method of claim 2, wherein:

the transfer containers are configured to be suspended from the first and second aerial cables en route from the loading tower to the unloading tower by means of a grip assembly; and each grip assembly comprises:

one or more rollers configured to move across an aerial cable; and a hook configured to releasably connect to and support a transfer container;

and wherein each of the transfer containers comprises a latching mechanism dimensioned to receive the hook, allowing the hook to support a respective transfer container along the first and second aerial cables.

4. The method of claim 3, wherein:

each of the transfer containers is configured to hold frac sand, frac iron, frac chemicals or field personnel;

a distance from the loading area to the transfer area is at least one mile; and a distance from the transfer area to the unloading area is also at least one mile.

5. The method of claim 4, wherein each of the plurality of transfer containers:

is configured to hold at least 500 $ft^3$ of sand;

at least some of the plurality of transfer containers has been pre-loaded with sand prior to arrival at the loading area, serving as sand boxes; and the staging area is dimensioned to receive over 100 sand boxes.

6. The method of claim 5, wherein each of the sand boxes:

has been delivered to the loading area by means of a truck; and is configured to be loaded onto the truck by means of a fork lift.

* * * * *